United States Patent [19]

Bartlett

[11] Patent Number: 4,625,827

[45] Date of Patent: Dec. 2, 1986

[54] MICROPHONE WINDSCREEN

[75] Inventor: Bruce Bartlett, Elkhart, Ind.

[73] Assignee: Crown International, Inc., Elkhart, Ind.

[21] Appl. No.: 788,037

[22] Filed: Oct. 16, 1985

[51] Int. Cl.[4] ..... G10K 13/00; F01N 7/00

[52] U.S. Cl. ..... 181/158; 181/242; 381/155

[58] Field of Search ..... 181/157, 158, 242, DIG. 1; 179/179, 180

[56] References Cited

U.S. PATENT DOCUMENTS 2,520,706 8/1950 Anderson et al. ..... 181/242

2,536,261 1/1951 Caldwell, Jr. ..... 181/242 X 3,154,171 10/1964 Knutson et al. ..... 181/242 X 4,401,859 8/1983 Watson ..... 181/158 X 4,410,770 10/1983 Hagey ..... 181/158 X

FOREIGN PATENT DOCUMENTS 855972 12/1960 United Kingdom .

*Primary Examiner*—Benjamin R. Fuller

*Attorney, Agent, or Firm*—Thomas J. Dodd

[57] ABSTRACT

A unidirectional microphone windscreen which includes portions formed of compressed foam and uncompressed foam located on opposite sides of the capsule to enhance directivity of the microphone.

3 Claims, 3 Drawing Figures

MICROPHONE WINDSCREEN

SUMMARY OF THE INVENTION

This invention relates to an external microphone windscreen which improves directivity of the microphone.

The microphone windscreen of this invention is formed of material of two different densities. The front portion of the screen into which a person speaks is formed of uncompressed foam while the rear portion of the screen behind the cartridge is formed of a higher density compressed foam. This construction allows the blocking of low frequency sounds through the back of the microphone and improves the front to back discrimination of the microphone. Examples of microphones which have utilized foam to reduce wind noise are seen in U.S. Pat. Nos. 2,536,261; 4,410,770; 2,520,706; 3,154,171 and British Pat. No. 855,972.

Accordingly, it is an object of this invention to provide for an improved windscreen which is for a microphone.

Another object of this invention is to provide for a microphone windscreen which improves directivity of the microphone.

Another object of this invention is to provide for a microphone windscreen which acts as an acoustic absorber at high frequencies.

Other objects of this invention will become apparent upon a reading of the following description.

DESCRIPTION OF THE PREFERRED EMBODIMENTS

The preferred embodiments herein described are not intended to be exhaustive or to limit the invention to the precise forms disclosed. They are shown and described to explain the principles of the invention and its application and practical use to enable others skilled in the art to utilize the invention.

Figure 1:
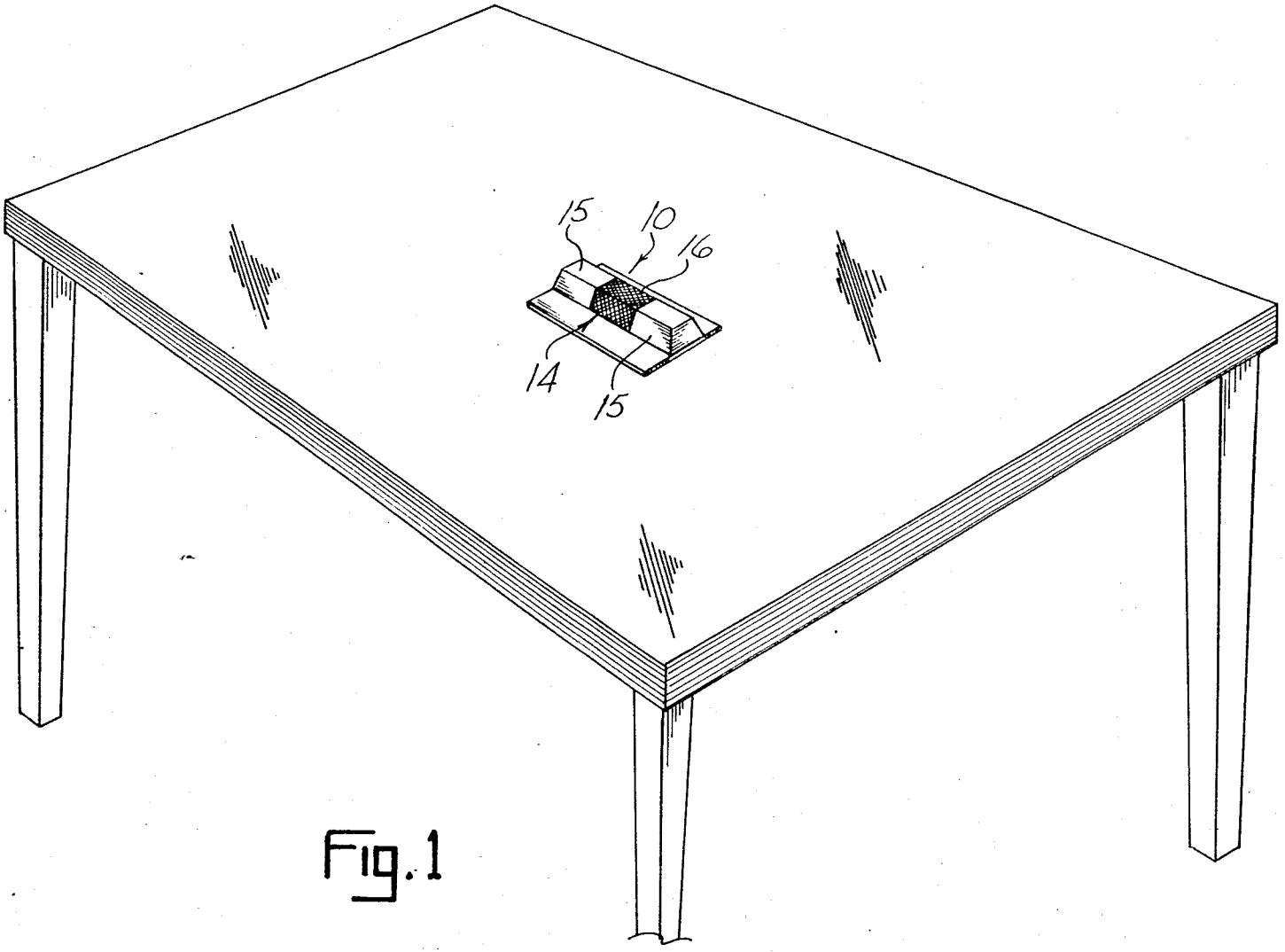
FIG. 1 is a perspective view of a unidirectional microphone incorporating the windscreen of this invention.
Figure 2:
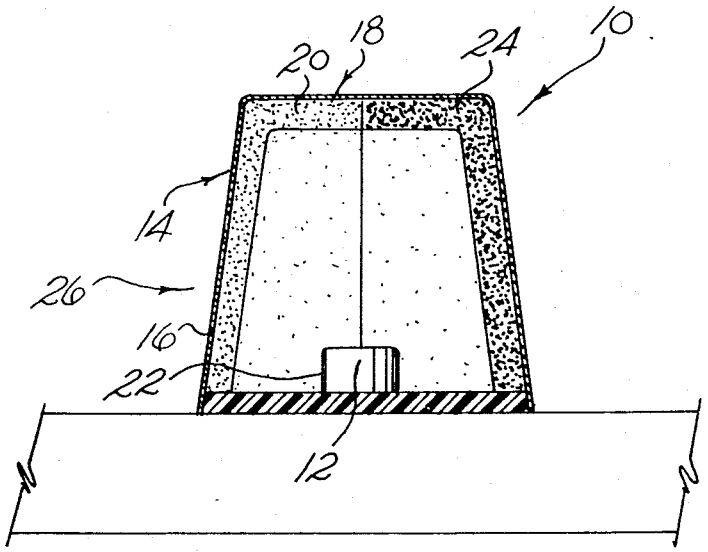
FIG. 2 is a cross-sectional view of the microphone of FIG. 1.

FIGS. 1 and 2 depict a unidirectional microphone 10 which includes a conventional unidirectional microphone cartridge or capsule 12. Microphone capsule 12 includes the sound reproducing elements and is connected to a suitable amplification source (not shown). Enclosing capsule 12 is a windscreen 14 seated between housing posts 15. Windscreen 14 which includes an outer layer 16 preferably formed of wire mesh. The inner layer 18 of windscreen 14 includes a front portion 20 positioned spacedly in front of the sound receiving entry 22 of capsule 12 and a rear portion 24 positioned spacedly at the opposite side of the capsule. Inner layer front portion 20 is formed of an uncompressed foam material such as polyurethane. Inner layer rear portion 24 is formed of a compressed foam material such as polyurethane.

Windscreen 14 functions as follows. As a person speaks into microphone 10 in the direction shown by arrow 26, sound travels through windscreen inner layer front portion 20 to capsule 12. The uncompressed foam of front portion 20 allows sound waves to pass readily through to capsule 12. The compressed foam of windscreen inner layer rear portion 24 prevents low frequency sounds from entering through the screen rear portion and also absorbs some high frequency sounds to improve front-to-back discrimination of the microphone.

Figure 3:
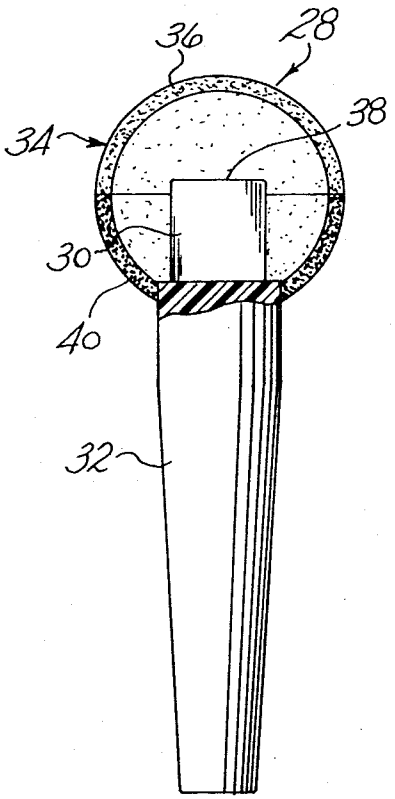
FIG. 3 is a sectional view of an alternative windscreen for a hand-held microphone.

An alternative microphone construction 28 shown in FIG. 3 involves a undirectional capsule 30 similar to capsule 12, mounted on a handle 32. A windscreen 34 having a portion 36 of uncompressed foam is positioned spacedly in front of the capsule sound receiving entry 38 and a portion 40 of compressed foam is positioned spacedly at the opposite side of the capsule. As with microphone 10, the windscreen 34 of microphone 28 improves the front-to-back discrimination of the microphone by blocking certain low frequency sounds and absorbing high frequency sounds at windscreen portion 40.

It is to be understood that the invention is not limited to the details above-given, but may be modified within the scope of the appended claims.

I claim:

1. In a unidirectional microphone, said microphone including a unidirectional capsule having a sound receiving entry, a windscreen positioned adjacent to said microphone capsule, the improvement wherein said windscreen includes a first portion formed of uncompressed cellular material positioned in front of said capsule sound receiving entry and a second portion formed of compressed cellular material positioned to the rear of said capsule opposite its sound receiving entry, said windscreen second portion constituting means for blocking and absorbing sound waves wherein the directivity of said microphone is enhanced.

2. The windscreen of claim 1 wherein said compressed cellular material is compressed polyurethane foam.

3. The windscreen of claim 2 wherein said uncompressed cellular material is uncompressed polyurethane foam.

* * * * *